US008347541B1

(12) United States Patent
Thompson

(10) Patent No.: US 8,347,541 B1
(45) **Date of Patent: *Jan. 8, 2013**

(54) POWER RAIL SYSTEM

(75) Inventor: John Thompson, Stone Mountain, GA (US)

(73) Assignee: Wolf Pac Technologies Corp., Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/417,466

(22) Filed: Mar. 12, 2012

Related U.S. Application Data

(63) Continuation of application No. 11/904,999, filed on Sep. 28, 2007, now Pat. No. 8,151,505.

(60) Provisional application No. 60/827,369, filed on Sep. 28, 2006.

(51) Int. Cl.
*F41C 27/00* (2006.01)

(52) U.S. Cl. ..... 42/84; 42/90

(58) Field of Classification Search ..... 42/90, 84, 42/72; 320/112, 113, 114
See application file for complete search history.

(56) References Cited

U.S. PATENT DOCUMENTS

| | | | |
|---|---|---|---|
| 5,103,366 | A | 4/1992 | Battochi |
| 5,142,806 | A | 9/1992 | Swan |
| 5,179,235 | A | 1/1993 | Toole |
| 6,218,043 | B1 | 4/2001 | Leung et al. |
| 6,548,205 | B2 | 4/2003 | Leung et al. |
| 6,622,416 | B2 | 9/2003 | Kim |
| 6,785,997 | B2 | 9/2004 | Oz |
| 6,931,775 | B2 | 8/2005 | Burnett |
| 7,059,076 | B2 | 6/2006 | Stoner et al. |
| 7,525,203 | B1 | 4/2009 | Racho |
| 7,627,975 | B1 | 12/2009 | Hines |
| 7,640,690 | B2 | 1/2010 | Hines |
| 2001/0002298 | A1 | 5/2001 | Leung et al. |
| 2004/0255767 | A1 | 12/2004 | Frasca |
| 2005/0252060 | A1 | 11/2005 | Gonzalez |
| 2005/0268519 | A1 | 12/2005 | Pikielny |
| 2009/0108589 | A1 | 4/2009 | Racho |
| 2010/0031552 | A1 | 2/2010 | Houde-Walter |
| 2010/0192446 | A1 | 8/2010 | Darian |
| 2010/0192447 | A1 | 8/2010 | Cabahug et al. |
| 2010/0192448 | A1 | 8/2010 | Darian |

OTHER PUBLICATIONS

U.S. Official Action dated Apr. 13, 2010 in U.S. Appl. No. 11/904,999.
U.S. Official Action dated Oct. 28, 2010 in U.S. Appl. No. 11/904,999.
U.S. Official Action dated Apr. 8, 2011 in U.S. Appl. No. 11/904,999.
U.S. Notice of Allowance/Allowability dated Jan. 9, 2012 in U.S. Appl. No. 11/904,999.

*Primary Examiner* — Jonathan C Weber
(74) *Attorney, Agent, or Firm* — Hope Baldauff Hartman, LLC

(57) ABSTRACT

A power supply system for a firearm including a plurality of leads disposed in a rail for providing power to an electric firearm accessory attached thereto and an electric firearm accessory including connectors for electrically connecting to leads disposed in a rail on which the accessory is mounted.

19 Claims, 5 Drawing Sheets

350
380
313
363
361
301
321
200
303
313
323
355
385
361
363

POWER RAIL SYSTEM

CROSS REFERENCE TO RELATED APPLICATIONS

This application is a continuation of U.S. patent application Ser. No. 11/904,999, entitled "Power Rail System," filed Sep. 28, 2007, now U.S. Pat. No. 8,151,505, which claims the benefit of U.S. Provisional Patent Application No. 60/827,369, entitled "Power Rail System," filed on Sep. 28, 2006. U.S. Pat. No. 8,151,505 and U.S. Provisional Patent Application 60/827,369 are expressly incorporated herein by reference in their entireties.

TECHNICAL FIELD

The present disclosure relates generally to firearms, and more particularly to a system for providing power to components or devices attached to a firearm.

BACKGROUND

Soldiers, sportsmen, and other firearm users sometimes find it desirable to include or attach one or more accessories of various kinds on a firearm. Some common accessories include sights, scopes, or other aiming devices or enhancements; flashlights, infrared lights, or other illumination devices; or other accessories to meet the needs of the user. Many of these, as well as other accessories for firearms, require a supply of electricity, such as a battery, to operate correctly or optimally.

A typical solution is the inclusion of a battery housed within the accessory device itself for provision of sufficient electrical power to operate the device. Unfortunately, many batteries are relatively heavy. Similarly, the batteries can be positioned inconveniently, for example, along the length of the barrel of the firearm, due to the mounting position of the accessory device. Such disadvantageous battery positioning can unsettle the desirable neutral balance of the firearm and can require the user to compensate for the additional weight disposed along the barrel when aiming the firearm. As a demonstrative example of the serious consequences of such unsettling, the additional weight of the battery within the accessory may cause the user to miss an intended target when firing, which can be disastrous for the user in a combat situation.

In an attempt to ameliorate the undesirable effect on the neutral balance of the firearm, accessory manufacturers have kept battery sizes small, thereby reducing the overall weight of the accessory. Although smaller batteries lessen the detrimental effect on the neutral balance of the firearm, they do so at the cost of battery life. Smaller, lighter batteries sometimes have less capacity and/or cannot provide power to the accessory for as long a time as a larger, heavier battery. In some cases, especially where the accessory is considered to be essential and/or where access to replacement batteries or electricity for recharging the battery is limited or non-existent, heavier batteries with longer life are used despite the detrimental effects on the balance of the firearm.

Another problem with battery operated firearm accessories is that each accessory, as provided by different manufacturers or even by the same manufacturer, can include circuitry designed to use a supply of electrical power having particular characteristics such as a specific voltage or current, thereby necessitating a variety of battery configurations. Replacing or recharging the batteries can be difficult and/or expensive due to the unique requirements of each accessory device.

SUMMARY

Therefore, what is needed is a system for providing electrical power to firearm accessories mounted on a firearm, wherein the system reduces or eliminates undesirable effects on the neutral balance of the firearm, does so without sacrificing battery life, and is capable of providing electrical power of varying characteristics, matching those required by various accessories. Briefly described, one embodiment of the concepts and technologies disclosed herein overcomes the above-mentioned disadvantages and provides a system for powering a firearm accessory. The system for powering the firearm accessory can include a power supply included in the firearm, a first positive lead, and a ground lead. The power supply can be connected to the first positive lead and to the ground lead to provide an electrical potential therebetween. Thus, a powered accessory can be attached or connected to the first positive lead and the ground lead to power the accessory.

According to some embodiments of the concepts and technologies disclosed herein, a power rail for supplying power to a firearm accessory connected thereto is disclosed. More specifically, one embodiment of the concepts and technologies disclosed herein includes a power supply system having at least one positive lead and a ground lead connected to a battery that can be disposed on or in a firearm.

Although some embodiments of the concepts and technologies disclosed herein are described as including a main power supply, some other embodiments of the concepts and technologies disclosed herein use alternative or back-up sources of power, such as a separate handle removably attached to the forearm, having a power source electrically connected to the power rail. Backup sources of power may be necessary or desirable in some circumstances. For example, a backup source of power may be desirable, inter alia, if a primary power source voltage falls below a threshold level, or if a fault in the primary power source renders the primary power source unusable.

According to some implementations of the power rail system, the at least one positive lead and the ground lead can be disposed in a rail. As such, an electric accessory for a firearm may preferably be connected to the rail, and thereby, may receive power from the power supply via the at least one positive lead and the ground lead. Additionally, the power rail can be configured to provide multiple consistent or multiple different voltages. In some embodiments, multiple different voltages can be carried, respectively, on multiple positive leads of the power rail system. A particular powered accessory can be configured to connect to an appropriate one of the positive leads.

According to another embodiment of the concepts and technologies disclosed herein, an electric accessory for attachment to a firearm is disclosed. The electric accessory can include a first connector for electrically connecting an electrical circuit of the electric accessory to a first positive lead of the firearm. The electric accessory further can include a second connector for electrically connecting the electrical circuit to a ground lead of the firearm. The electric accessory can be powered by a power supply of the firearm via the first connector and the second connector.

In another embodiment of the concepts and technologies disclosed herein, an electric accessory for a firearm is configured to obtain power from a power supply of the firearm. In particular, in some embodiments of the concepts and technologies disclosed herein, an electric accessory for a firearm includes a positive connector and a ground connector connected to a positive lead of the firearm and a ground lead of the firearm, respectively. At least one positive lead and the ground lead are preferably disposed in a rail of the firearm. As such, a power supply disposed in or on the firearm may supply power to the electric accessory via the positive connector and the ground connector. Additionally, or alternatively, different voltages may be carried on different positive leads and the electric assembly can connect to an appropriate one of the positive leads.

Accordingly, some embodiments of the concepts and technologies disclosed herein are configured to eliminate a need for a battery disposed within an electric accessory attached to the power rail system disclosed herein.

Some embodiments of the concepts and technologies disclosed herein therefore can be used to maintain a neutral balance of a firearm when an electric accessory is attached to the firearm.

Some embodiments of the concepts and technologies disclosed herein can be used to selectively supply multiple different voltages to power a corresponding one of multiple electric accessories, wherein each of the electric accessories may require a different voltage.

Some embodiments of the concepts and technologies disclosed herein can be used to enable adjustment of a position of an electric accessory on a firearm while maintaining a supply of power to the electric accessory.

Some embodiments of the concepts and technologies disclosed herein can be used to provide a power rail having multiple removable and connectable sections for altering a length of the power rail.

Some embodiments of the concepts and technologies disclosed herein can be installed on a conventional firearm by replacing conventional components of the firearm.

Some embodiments of the concepts and technologies disclosed herein can be used to provide a back-up power supply to a battery-powered firearm accessory.

Some embodiments of the concepts and technologies disclosed herein can be used to recharge a battery-powered firearm accessory.

Some embodiments of the concepts and technologies disclosed herein can be used to provide a switch on a forearm, grip, stock, or other location for selectively controlling power supplied to one or more electric accessories attached to a power rail system.

Some embodiments of the concepts and technologies disclosed herein can be used to provide a backup or alternative power source for electric accessories in the event a primary power source becomes unavailable.

These and other features and advantages of various embodiments of the concepts and technologies disclosed herein will become more apparent to one skilled in the art from the following description and claims when read in light of the accompanying drawings.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
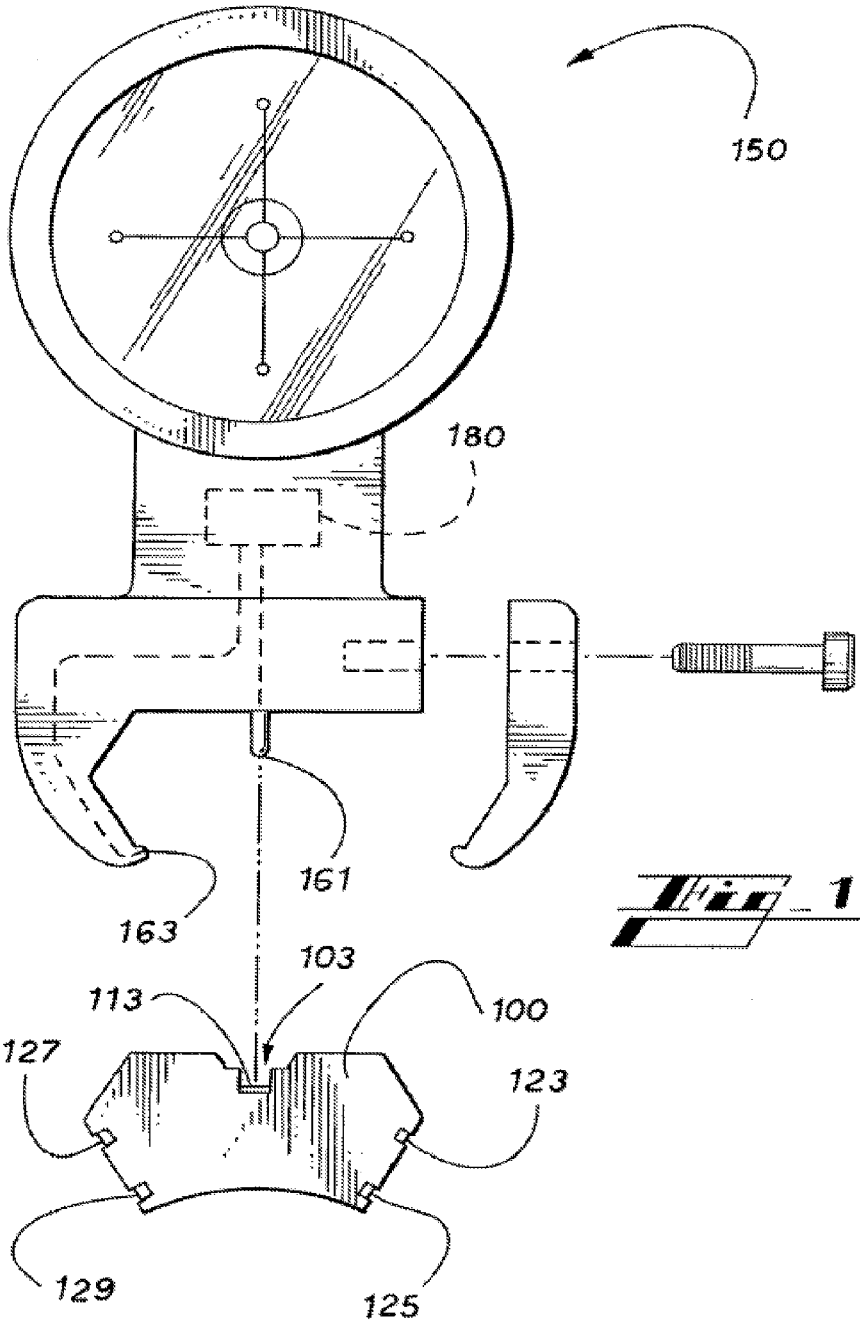
FIG. 1 is a cross-sectional view of a firearm rail, according to an illustrative embodiment.

In the following detailed description, references are made to the accompanying drawings that form a part hereof, and in which are shown by way of illustration specific embodiments or examples. Referring now to the drawings, in which like numerals represent like elements throughout the several FIGURES, aspects of a power rail system will be described in detail. In describing the various embodiments of the concepts and technologies disclosed herein, as illustrated in FIGS. 1-7, specific terminology is employed for the sake of clarity. The various embodiments of the concepts and technologies disclosed herein, however, are not limited to the specific terminology selected, and it is to be understood that each specific element includes all technical equivalents that operate in a similar manner to accomplish similar functions.

Referring now to FIG. 1, by way of example, and not limitation, there is illustrated a cross-sectional view of a rail 100. In the illustrated embodiment, the rail 100 includes a ground lead 113 disposed in a channel 103. The rail 100 also includes positive leads 123, 125, 127, and 129. The rail 100 can be formed from and/or can include an electrically insulating material such as a plastic, a rubber, a ceramic, other suitable materials, and/or combinations thereof, such that each of the leads 113, 123, 125, 127, 129 can be electrically insulated from one another. In some embodiments, the rail 100 is formed from and/or includes an electrically conductive material such as a metal or other suitable material. Thus, in some embodiments the ground lead 113 may be eliminated and the rail 100 may provide the functionality described herein with reference to the ground lead. It will be understood by one of ordinary skill in the art that the positive leads 123, 125, 127, 129 may include external insulation such that each lead 123, 125, 127, 129 can be electrically insulated from the other leads and/or from the rail 100. In some embodiments, two or more of the positive leads 123, 125, 127, 129 can carry different voltages relative to one another. The different voltages carried by the positive leads 123, 125, 127, 129 can be appropriate for different electric accessories.

In use, an electric accessory 150 for a firearm, such as a sight, a scope, or other aiming device or enhancement; a flashlight, an infrared light, or other illumination device; a laser, a Taser, a night-vision apparatus; or any other desired electric accessory; can include a first connector 161 for connecting an electric circuit 180 of the electric accessory 150 to a ground lead 113. The electric accessory 150 also can include a second connector 163 for connecting the electric circuit 180 of the electric accessory 150 to one of the positive leads 123, 125, 127, 129. The electric accessory 150 may be removably and/or adjustably mounted on the rail 100 such that the first connector 161 can be electrically connected to the ground lead 113, and such that the second connector 163 can be electrically connected to one of the positive leads 123, 125, 127, 129.

Figure 2:
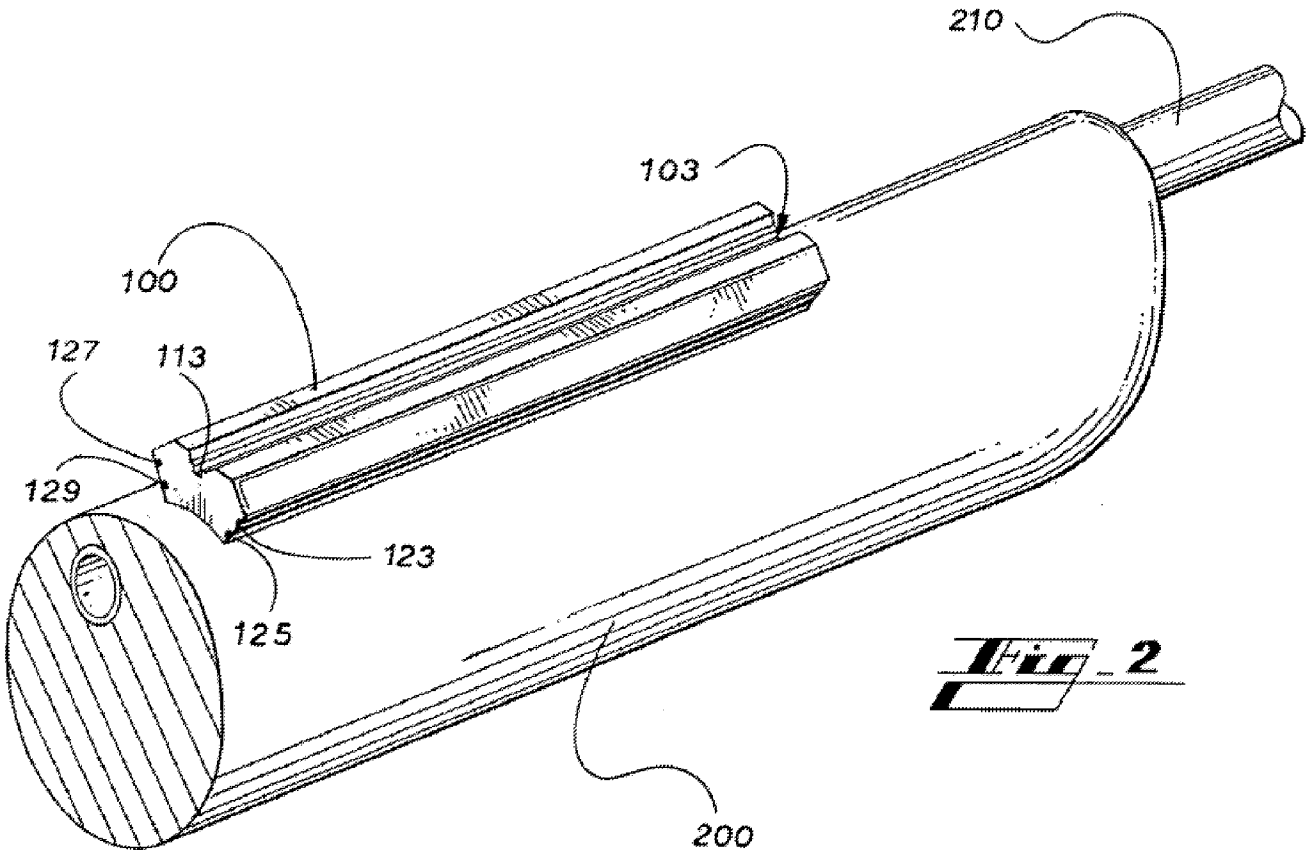
FIG. 2 is a perspective view of the firearm rail of FIG. 1 attached to a forearm, according to an illustrative embodiment.

Now referring to FIG. 2, the rail 100 can be disposed on top of a forearm 200, which may be mounted on a barrel 210 of a firearm. As shown in FIG. 2, the ground lead 113 can be accessible from the top of the rail 100, and the positive leads 123, 125 can be accessible from a side of the rail 100. It should be understood that this embodiment is illustrative, and should not be construed as being limiting in any way.

Figure 3:
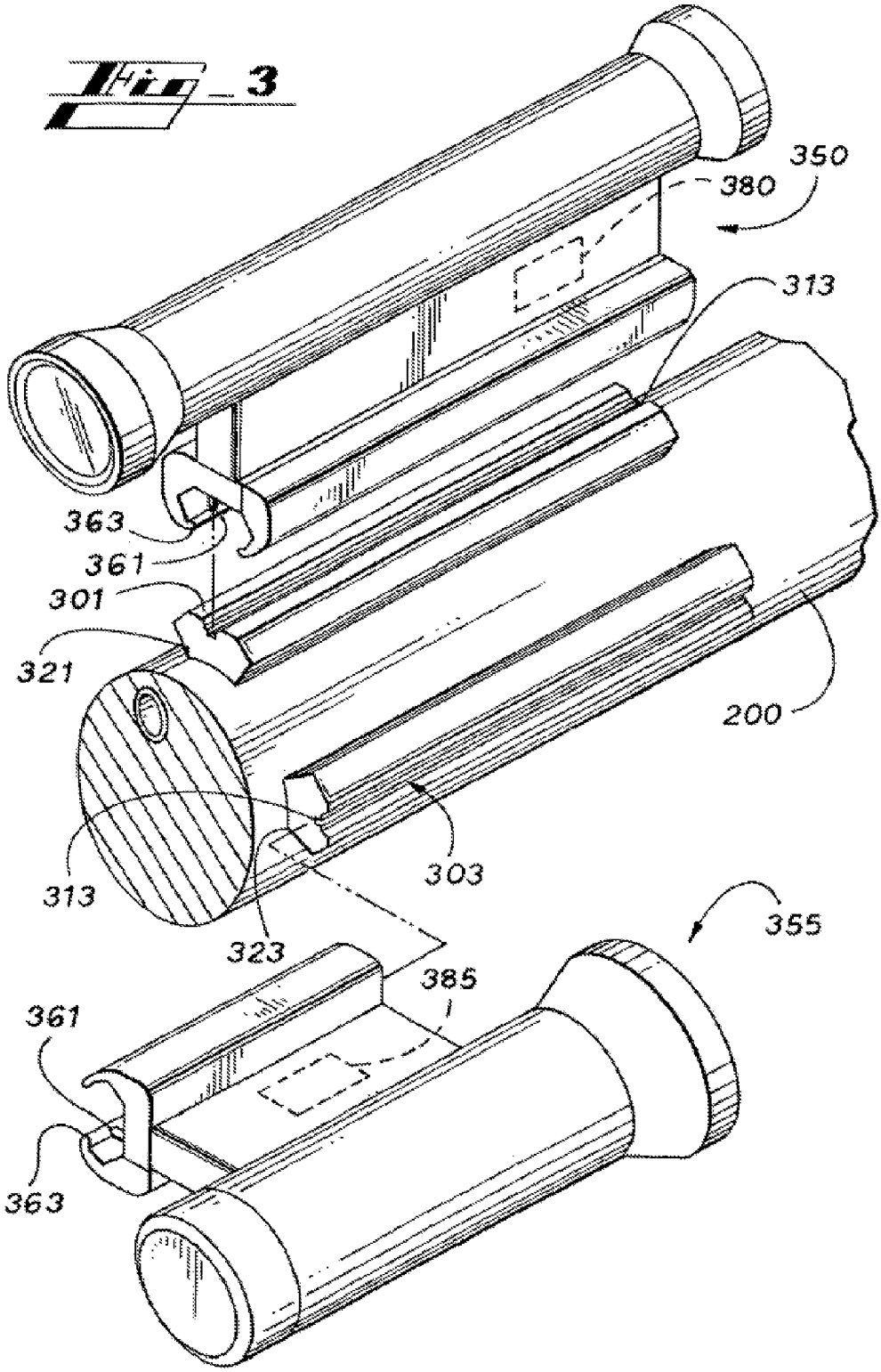
FIG. 3 is a perspective view of a rail system, according to another illustrative embodiment.

In an alternative embodiment illustrated in FIG. 3, multiple rails 301, 303 can be disposed at different locations on the forearm 200. While two rails 301, 303 are shown, it will be apparent to those of ordinary skill in the art that other numbers of rails 301, 303 arranged in various configurations may be provided. In the embodiment of FIG. 3, each of the rails 301, 303 can include a ground lead 313, which may optionally be electrically connected to provide a common ground. In some embodiments, the rail 301 can have one positive lead 321, and the rail 303 also can have one positive lead 323. Each of the positive leads 321, 323 can be connected to a positive terminal of a power supply. As such, a voltage differential can exist between the positive leads 321, 323 and the ground leads 313. In some embodiments, the positive lead 321 can carry a first voltage, and the positive lead 323 can carry a second voltage that differs from the first voltage. As such, electric accessories 350, 355 for a firearm may be mounted to a selected one of rails 301, 303 according to a voltage supply required by the electric accessory and/or a voltage provided by the respective rails 301, 303. Additionally, or alternatively, each of the rails 301, 303 can include multiple positive leads, as discussed above with respect to the rail 100.

The electric accessories 350, 355 can have respective first connectors 361 and second connectors 363. The first connectors 361 and the second connectors 363 can be designed to make an electrical connection between the ground leads 313 and the positive leads 321, 323, and electronic circuits 380, 385, respectively, in order to provide power of an appropriate voltage. Each electric accessory attached to the power supply system 400 (described in more detail in FIG. 4 below) may have a power switch disposed on the electric accessory for deactivating the individual electric accessory without interrupting or otherwise affecting the power to power supply system 400.

Figure 4:
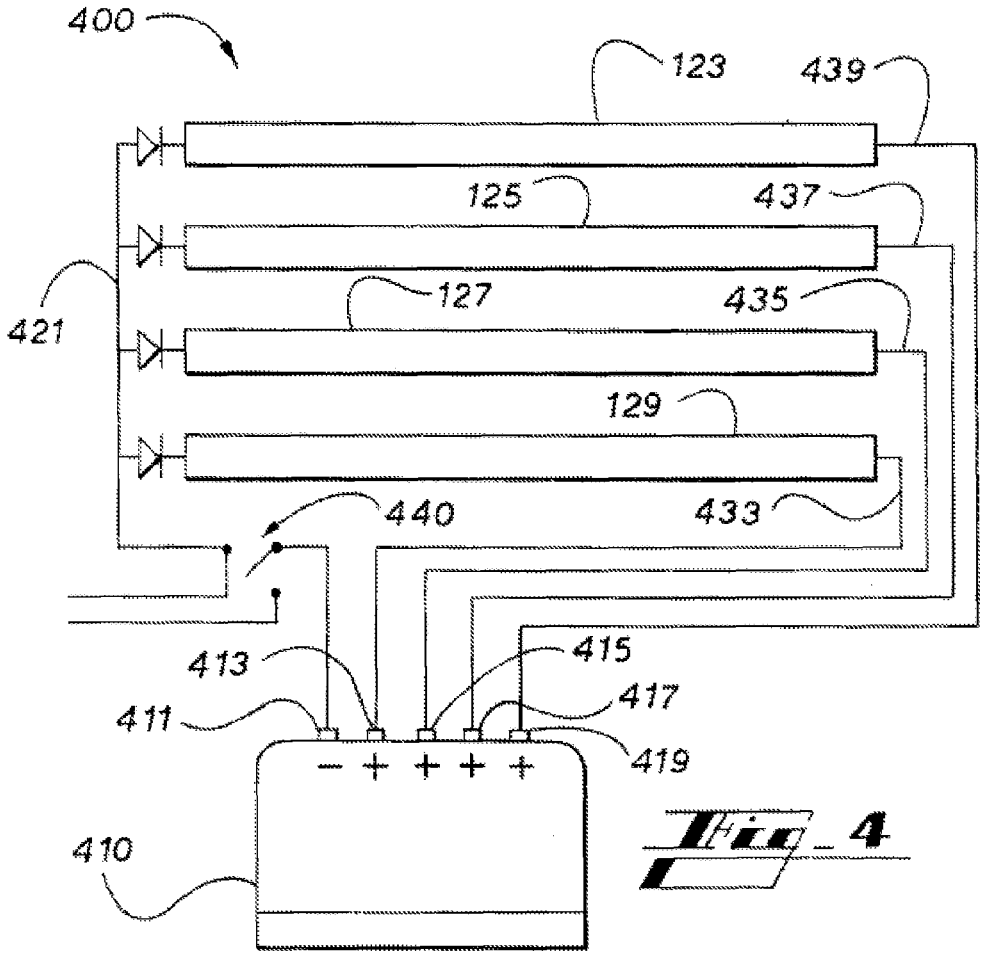
FIG. 4 is a schematic view of a power supply system for powering a firearm accessory, according to an illustrative embodiment.

Now referring to FIG. 4, a power supply system 400 can include a battery 410. The battery 410 can include a ground terminal 411 and one or more positive terminals 413, 415, 417. The ground terminal 411 can be connected to a ground lead 421. Each of the positive terminals 413, 415, 417 can supply a different voltage. For example, in some embodiments the positive terminals 413, 415, 417 supply, respectively, +4.5 volts, +6 volts, +9 volts, and/or other voltages selected to power a particular electric accessory, which can be connected to a respective one of the positive leads 433, 435, 437, 439. The positive leads 433, 435, 437, 439 can share a common ground lead 421. It should be understood that these embodiments are illustrative, and should not be construed as being limiting in any way.

In one embodiment of the concepts and technologies disclosed herein, a switch 440 may be used to disconnect the ground lead 411 from the battery 410, and to connect the ground lead 411 to an alternative power supply (not shown) should the voltage output of the battery 410 be insufficient to maintain proper operation of one or more accessories connected thereto. Because the switch 440 disconnects power from the power supply system 400 the ground lead 411, the supply of power to all electric accessories (not shown but illustrated in FIG. 3 above) may be interrupted via the a single switch such as the switch 440, whereby the complexity of operating multiple switches associated with a respective positive lead or device of the system may be reduced, which may be of vital importance during battle conditions. It should be understood that this embodiment is illustrative, and should not be construed as being limiting in any way.

It will be understood that the power supply system 400 may optionally include variable resistors, solid state components, or other means for altering a voltage available to an accessory. Furthermore, one or more additional or alternative switches may be provided whereby power to one or more selected associated positive leads and/or rails may be controlled.

Figure 5:
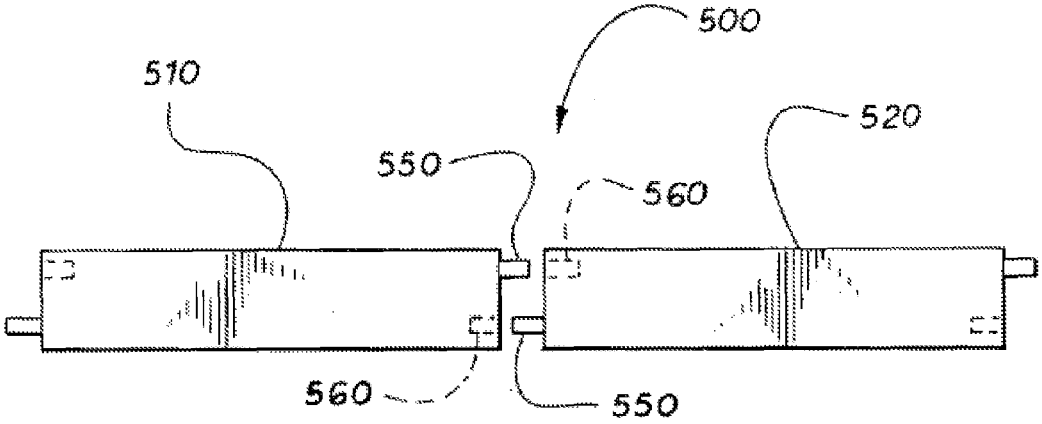
FIG. 5 is a perspective view of a rail system, according to an illustrative embodiment.

FIG. 5 illustrates a rail 500 according to an alternative configuration. The rail 500 includes multiple rail sections 510, 520. Each of the rail sections 510, 520 may include rails such as the rails 100, 301, 303, and can include a male connector 550 and a female connector 560. The male connector 550 and the female connector 560 can be used to enable the rail sections 510, 520 to be combined to form a single rail such as the rail 500. Thus, a length of the rail 500 may be adjusted to fit a particular firearm or a particular application by selective combination of the rail sections 510, 520. It should be understood that this embodiment is illustrative, and should not be construed as being limiting in any way.

Figures 6, 7:
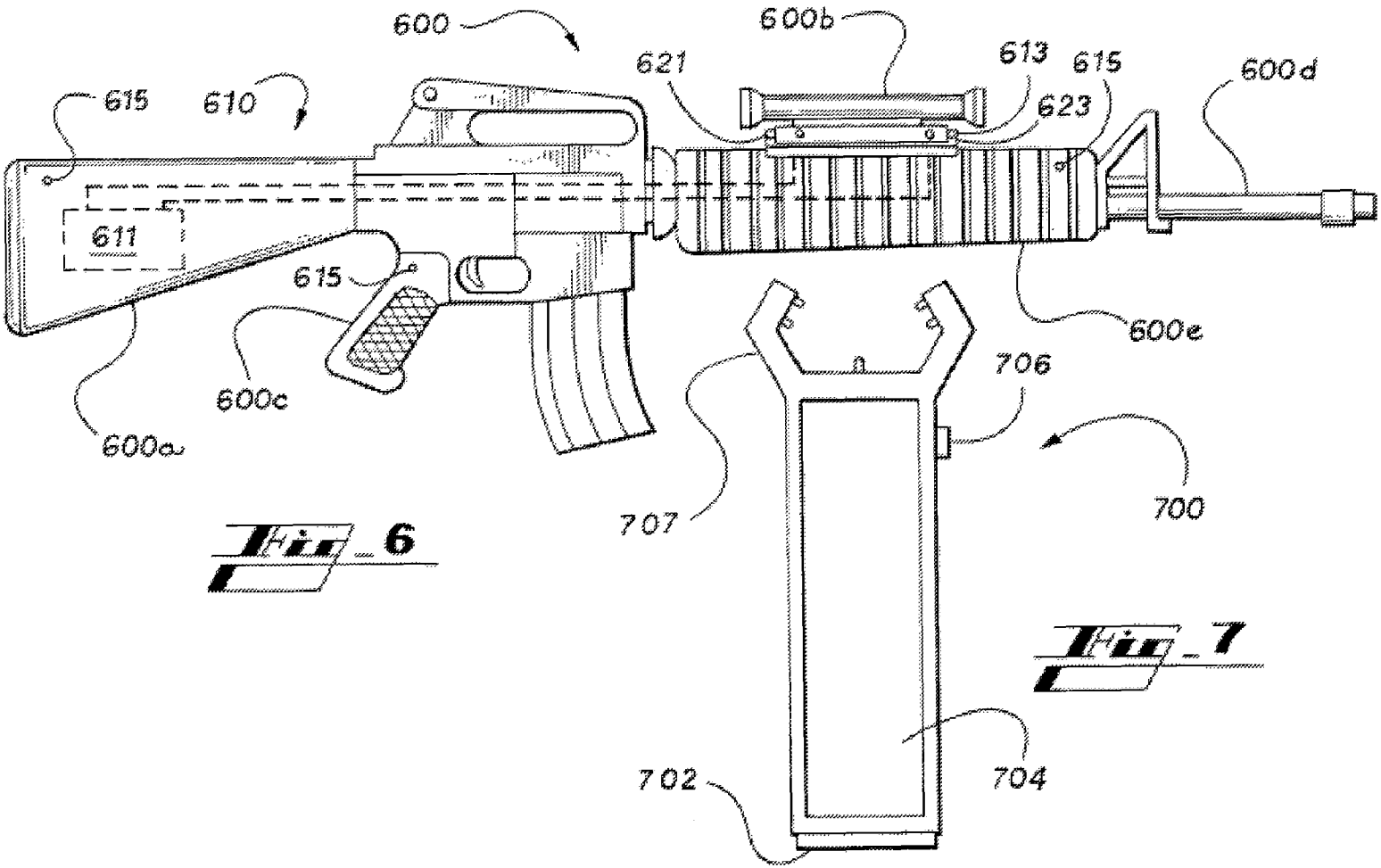
FIG. 6 is a partial cut-away perspective view of a firearm including an accessory power system, according to an illustrative embodiment.
FIG. 7 is a front view of an alternative power source for use with the power system, according to an illustrative embodiment.

FIG. 6 illustrates a firearm 600. The firearm 600 can include, for example, an M16, an M4, an AR-15, or the like. In FIG. 6, the firearm 600 includes a power system 610. A multi-tap battery 611 can be disposed within a stock 600*a* of the firearm 600 and can be electrically connected to an electric accessory 600*b* via a ground lead 621 and a positive lead 623 of a rail 613. Alternatively, the multi-tap battery 611 may be disposed within a grip 600*c* of the firearm 600, a forearm 600*e* of the firearm 600, within another void of firearm 600, and/or may be attached to an exterior of the stock 600*a*, the grip 600*c*, the barrel 600*d*, the forearm 600*e*, or another part of firearm 600. As will be understood by one of ordinary skill in the art, other mounting means for the battery may be implemented, including receptacles into which the battery may be inserted and from which it may be ejected, and remote support, such as in or on the clothing or other equipment of a user. Preferably, the location of the multi-tap battery 611 is selected such that a balance of the firearm 600 is achieved in order to maintain or achieve desirable aiming characteristics.

According to another alternative configuration, the firearm 600 may include more than one battery disposed in various locations and providing different voltages, or more than one multi-tap battery disposed in various locations. Furthermore, the electric accessory 600*b* may include a battery that may optionally be rechargeable (described more fully with reference to FIG. 7 below), or may rely solely on the power system 610 for electric power.

It will also be understood that non-electric accessories may additionally be mounted to the rail 613. It will further be understood that the switches 615 may be installed near the stock 600*a*, the grip 600*c*, the forearm 600*e*, or at another desired location on the firearm 600 to enable selective operation of the electric accessory 600*b*. It will further be understood that the power system 610 may optionally power non-firearm related accessories, such as communication devices, orienting devices, sensor equipment, computers, or any other electronic device provided with appropriate connectors enabling electrical connection to the power system 610.

Referring now to FIG. 7, in an alternative embodiment of the concepts and technologies disclosed herein, an alternative power source is provided. More specifically, FIG. 7 shows a forearm support 700 having a multi-voltage/multi-tap battery 704 disposed therewithin. During normal operation, electrical contacts 707 may be disconnected from the power supply system 400. In order to switch from the main battery 410 to the battery 704, the user may open the switch 440 to disconnect the battery 410 and may activate the switch 706 to connect the battery 704 to provide power to the power system 400. The battery 704 may readily be inserted or removed, depending upon user preference or operational concerns, by opening and removing the battery 704 using the operable door 702, which can provide access to the inner portion of the forearm support 700.

Having thus described illustrative embodiments of the concepts and technologies disclosed herein, it should be noted by those ordinarily skilled in the art that the within disclosures are illustrative only, and that various other alternatives, adaptations, and modifications may be made without departing from the scope of the various embodiments of the concepts and technologies disclosed herein. Accordingly, the various embodiments of the concepts and technologies disclosed herein are not limited to the specific embodiments illustrated herein, but rather are limited only by the scope of the following claims.

I claim:

1. A power rail system comprising:

a first accessory rail attached to a firearm, the first accessory rail comprising a first positive lead disposed at an external surface of the first accessory rail and extending along a length of the first accessory rail, and a first ground lead disposed at the external surface of the first accessory rail and extending along the length of the first accessory rail;

a second accessory rail attached to the firearm, the second accessory rail comprising a second positive lead disposed at an external surface of the second accessory rail and extending along a length of the second accessory rail, and a second ground lead disposed at the external surface of the second accessory rail and extending along the length of the second accessory rail;

a third accessory rail attached to the firearm; and a battery connected to the third accessory rail, the battery being electrically connected via the third accessory rail to the first positive lead, the second positive lead, the first ground lead, and the second ground lead to provide a voltage to the first accessory rail and the second accessory rail.

2. The power rail system of claim 1, wherein the first accessory rail further comprises a third positive lead.

3. The power rail system of claim 2, wherein the battery is connected to the first positive lead, the third positive lead, and the first ground lead to provide a plurality of voltages to the first accessory rail.

4. The power rail system of claim 3, wherein the plurality of voltages comprises a first voltage and a second voltage.

5. The power rail system of claim 4, wherein the first voltage and the second voltage are different from one another.

6. The power rail system of claim 1, wherein the first accessory rail is formed from an electrically insulating material, and wherein the first positive lead is insulated from the first ground lead by the accessory rail.

7. The power rail system of claim 1, wherein the first accessory rail is formed from a conductive material, wherein the first ground lead is formed as a portion of the first accessory rail, and wherein the first positive lead is insulated from the first accessory rail by an insulating material.

8. The power rail system of claim 1, wherein the battery comprises a plurality of positive terminals, and wherein each of the plurality of positive terminals provides a different voltage.

9. The power rail system of claim 1, wherein each of the first positive lead, the second positive lead, the first ground lead, and the second ground lead are continuous, and wherein an electric accessory connected to the first accessory rail or the second accessory rail at any location along respective lengths of the first accessory rail or the second accessory rail is powered by the battery.

10. The power rail system of claim 1, further comprising a fourth accessory rail attached to the forearm of the firearm, the fourth accessory rail comprising a fourth positive lead disposed at an external surface of the fourth accessory rail and extending along a length of the fourth accessory rail, and a third ground lead disposed at the external surface of the fourth accessory rail and extending along the length of the fourth accessory rail.

11. A power rail system comprising:

a first accessory rail attached to a forearm of a firearm, the first accessory rail being formed from an electrically insulating material and comprising a first continuous positive lead disposed at an external surface of the first accessory rail and extending along a length of the first accessory rail, a second continuous positive lead disposed at the external surface of the first accessory rail and extending along the external surface of the first accessory rail, and a first continuous ground lead disposed at the external surface of the first accessory rail and extending along the length of the first accessory rail, wherein the first continuous ground lead is insulated from the first positive lead and the second positive lead, and wherein an electric accessory can be attached to the first continuous positive lead, the second continuous positive lead, or the first continuous ground lead at any location along the length of the first accessory rail;

a second accessory rail attached to the forearm of the firearm, the second accessory rail comprising a third continuous positive lead disposed at an external surface of the second accessory rail and extending along a length of the second accessory rail, and a second continuous ground lead disposed at the external surface of the second accessory rail and extending along the length of the second accessory rail, wherein the electric accessory can be attached to the third continuous positive lead and the second continuous ground lead at any location along the length of the second accessory rail;

a third accessory rail attached to the firearm; and a battery connected to the third accessory rail, the battery being electrically connected via the third accessory rail to the first continuous ground lead and at least one of the first continuous positive lead or the second continuous positive lead and to provide a first voltage to the first accessory rail, and the second continuous ground lead and the third continuous positive lead and to provide a second voltage to the second accessory rail.

12. The power rail system of claim 11, wherein the first voltage is different from the second voltage.

13. The power rail system of claim 11, wherein the first voltage and the second voltage are equivalent.

14. A power rail system comprising:

a first accessory rail attached to a forearm of a firearm, the first accessory rail comprising a first positive lead disposed at an external surface of the first accessory rail and extending along a length of the first accessory rail, and a first ground lead disposed at the external surface of the first accessory rail and extending along the length of the first accessory rail;

a second accessory rail attached to the forearm of the firearm, the second accessory rail comprising a second positive lead disposed at an external surface of the second accessory rail and extending along a length of the second accessory rail, and a second ground lead disposed at the external surface of the second accessory rail and extending along the length of the second accessory rail;

a third accessory rail attached to the forearm of the firearm, the third accessory rail comprising a third positive lead disposed at an external surface of the third accessory rail and extending along a length of the third accessory rail, and a third ground lead disposed at the external surface of the third accessory rail and extending along the length of the third accessory rail;

a fourth accessory rail attached to the forearm of the firearm; and a battery connected to the fourth accessory rail, the battery being electrically connected via the fourth accessory rail to the first positive lead, the second positive lead, the third positive lead, the first ground lead, the second ground lead, and the third ground lead to provide a voltage to the first accessory rail, the second accessory rail, and the third accessory rail.

15. The power rail system of claim 14, wherein the first accessory rail further comprises a fourth positive lead.

16. The power rail system of claim 15, wherein the battery is connected to the first positive lead, the fourth positive lead, and the first ground lead to provide a plurality of voltages to the first accessory rail.

17. The power rail system of claim 16, wherein the plurality of voltages comprises at least a first voltage and a second voltage.

18. The power rail system of claim 17, wherein the first voltage is different from the second voltage.

19. The power rail system of claim 17, wherein the first voltage and the second voltage are equal.

* * * * *